US007061392B2

(12) United States Patent
Hawkinson

(10) Patent No.: US 7,061,392 B2
(45) Date of Patent: Jun. 13, 2006

(54) SYSTEM AND METHOD OF DISABLING AN EVACUATION LOCATION DEVICE

(75) Inventor: Daniel C. Hawkinson, Elburn, IL (US)

(73) Assignee: Honeywell International, Inc., Morristown, NJ (US)

( * ) Notice: Subject to any disclaimer, the term of this patent is extended or adjusted under 35 U.S.C. 154(b) by 77 days.

(21) Appl. No.: 10/734,961

(22) Filed: Dec. 12, 2003

(65) Prior Publication Data

US 2005/0128066 A1 Jun. 16, 2005

(51) Int. Cl.
*G08B 3/00* (2006.01)

(52) U.S. Cl. ..... 340/691.1; 340/326; 340/331; 340/628; 340/693.6; 340/825.36

(58) Field of Classification Search ..... 340/326, 340/331, 628, 691.1, 693.6, 825.36
See application file for complete search history.

(56) References Cited

U.S. PATENT DOCUMENTS 6,133,839 A * 10/2000 Ellul et al. ..... 340/584
6,150,943 A * 11/2000 Lehman et al. ..... 340/628
6,201,470 B1 3/2001 Withington
6,646,545 B1 * 11/2003 Bligh ..... 340/286.05
6,842,120 B1 * 1/2005 Colberg et al. ..... 340/691.1
2002/0149491 A1 * 10/2002 Crandall et al. ..... 340/691.1
2003/0085811 A1 * 5/2003 Fitzpatrick ..... 340/628
2004/0075572 A1 * 4/2004 Buschmann et al. ..... 340/691.1

FOREIGN PATENT DOCUMENTS

AU 199660124 B1 2/1997
EP 0 846 311 B1 6/1998
EP 0 846 311 B9 6/1998
EP 1 225 551 A1 7/2002
GB 2 303 235 A 2/1997
GB 2 318 662 A 4/1998
WO WO 97/03424 1/1997

* cited by examiner

*Primary Examiner*—Thomas J. Mullen, Jr.
*Assistant Examiner*—Samuel J. Walk
(74) *Attorney, Agent, or Firm*—Welsh & Katz, Ltd.

(57) ABSTRACT

An exit path indicating device incorporates at least a first port for receiving an alarm indicating signal. In normal operation upon receipt of the alarm indicating signal, the device outputs a visual or an audible, or both, indicator of the presence of an exit or egress path for use in evacuating the region. A second port disables the operation of the device. The second port can be coupled to a local sensor which provides an indication of a hazardous or alarm condition adjacent to or on the exit or egress path. If the sensor is indicating the presence of a hazardous or alarm condition, the indicating device can be disabled.

17 Claims, 2 Drawing Sheets

SYSTEM AND METHOD OF DISABLING AN EVACUATION LOCATION DEVICE

FIELD OF THE INVENTION

The invention pertains to an indicating devices of a type used in alarm systems for indicating exit paths in the event of an alarm condition. More particularly, the invention pertains to such devices which can be disabled in the event that the respective exit or output path is unsuited for use.

BACKGROUND

It has been known to install evacuation path or exit path indicating devices in regions being monitored to assist individuals in the respective regions to evacuate the region in the event of an alarm condition. Such devices provide either visual indicators, such as strobe lights or other types of exit identifying symbols, or audible indicators, such as sounders, or both, of the presence of an exit or an evacuation path. One known type of device is a broadband directional sounder.

Unfortunately at times when an alarm condition is present, such as a fire for example, one or more of the evacuation paths or exits might become unsuitable for use. Conditions that might result in unsuitability would include the presence of fire or smoke adjacent to, or, on the respective evacuation path or at the respective exit. It would be desirable to be able to provide supplemental information to individuals in the region as to the suitability of the various paths, or exits, for leaving the respective region. Preferably such information could be provided without substantially increasing the cost of the egress path indicating devices. Also, it would be preferably if such functionality could be readily incorporated into existing systems.

DESCRIPTION OF THE PREFERRED EMBODIMENTS

Figure 1:
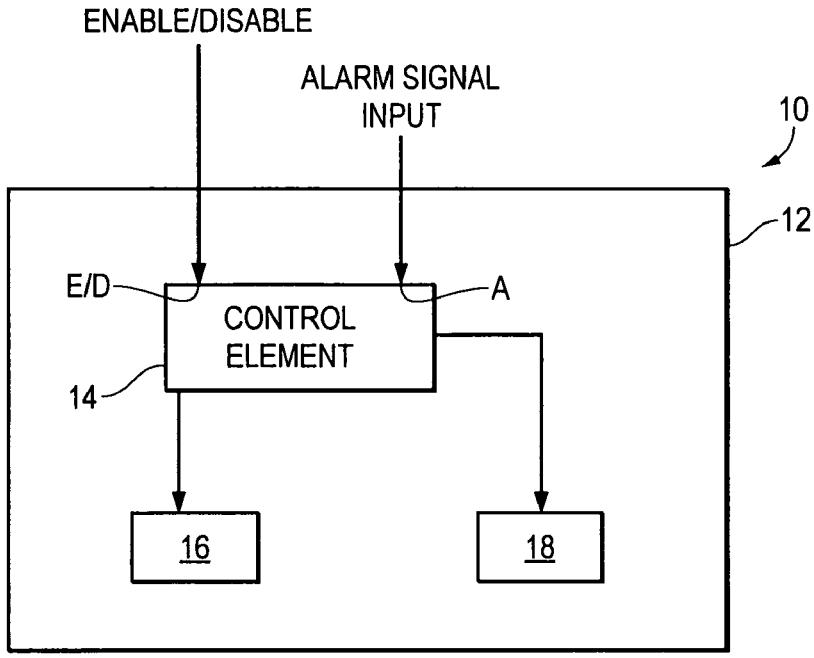
FIG. 1 is block diagram of an egress path indicating output device.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 is a block diagram of an exit path or egress indicating device 10. The device 10 has a housing 12 which carries a control element 14. Control element 14 could be implemented with a variety of technologies without departing from the spirit and scope of the invention. Electromechanical relays could be used as well as solid state circuitry all without limitation.

Control element 14 receives two different input signals. An alarm input signal can be coupled to an alarm input port A for purposes of activating the device 10. A second port E/D can be used to enable or disable the device 10 as described in more detail subsequently. Control element 14 is coupled to one or both of an exit or egress path audible indicating device 16 or a visual exit or path indicating device, such as a lighted symbol or strobe unit, 18.

As those that are skilled in the art will understand, in the presence of an alarm input, port A, the unit 10 provides audible output signals, which could include synthetic voice horns, sirens, or the like without limitation, via output device 16, or, visual output indicators, such as by illuminating a symbol or flashing a strobe light, via output device 18 to indicate to individuals in the vicinity the location of an exit or egress path. As also would be known by those skilled in the art, the alarm input signal which would activate a plurality of devices, such as the device 10, does not take into account the local conditions in the vicinity of the device 10 at that time. In the prior art, the devices 10 are automatically activated inspective of local conditions in response to the alarm input signal, port A.

Figure 2:
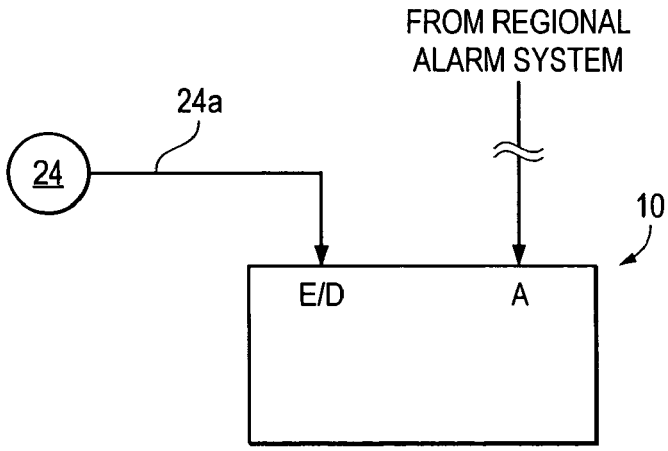
FIG. 2 is a schematic diagram illustrating a detector coupled to an indicating device, as in FIG. 1, and in accordance with the invention.

FIG. 2 illustrates an embodiment of the present invention wherein the exit or path indicating device 10 is coupled to an ambient condition detector 24 which could be locally positioned relative to the device 10. The detector 24 could, for example, be a fire detector such as a smoke detector, flame, or gas detector without limitation.

An output signal from the detector 24, coupled via line 24*a* to the E/D port of the unit 10 can be used to disable the unit 10 in the presence of a locally sensed, hazardous, smoke or fire condition. For example, if the regional alarm system has activated the devices 10 via the port A, and, some of the devices 10 which would indicate an escape path are in the vicinity of the fire, it would be desirable to disable those devices so as to not cause individuals in the region to expose themselves to the fire.

By coupling locally situated detectors, such as the detector 24 to the path indicating devices 10, those devices which are adjacent to or near the fire condition would be disabled by the output, line 24*a* from the detector 24. Hence, individuals in the region would not be attracted to that segment, path, or exit which would lead the person or persons toward or into smoke or fire.

Figure 3:
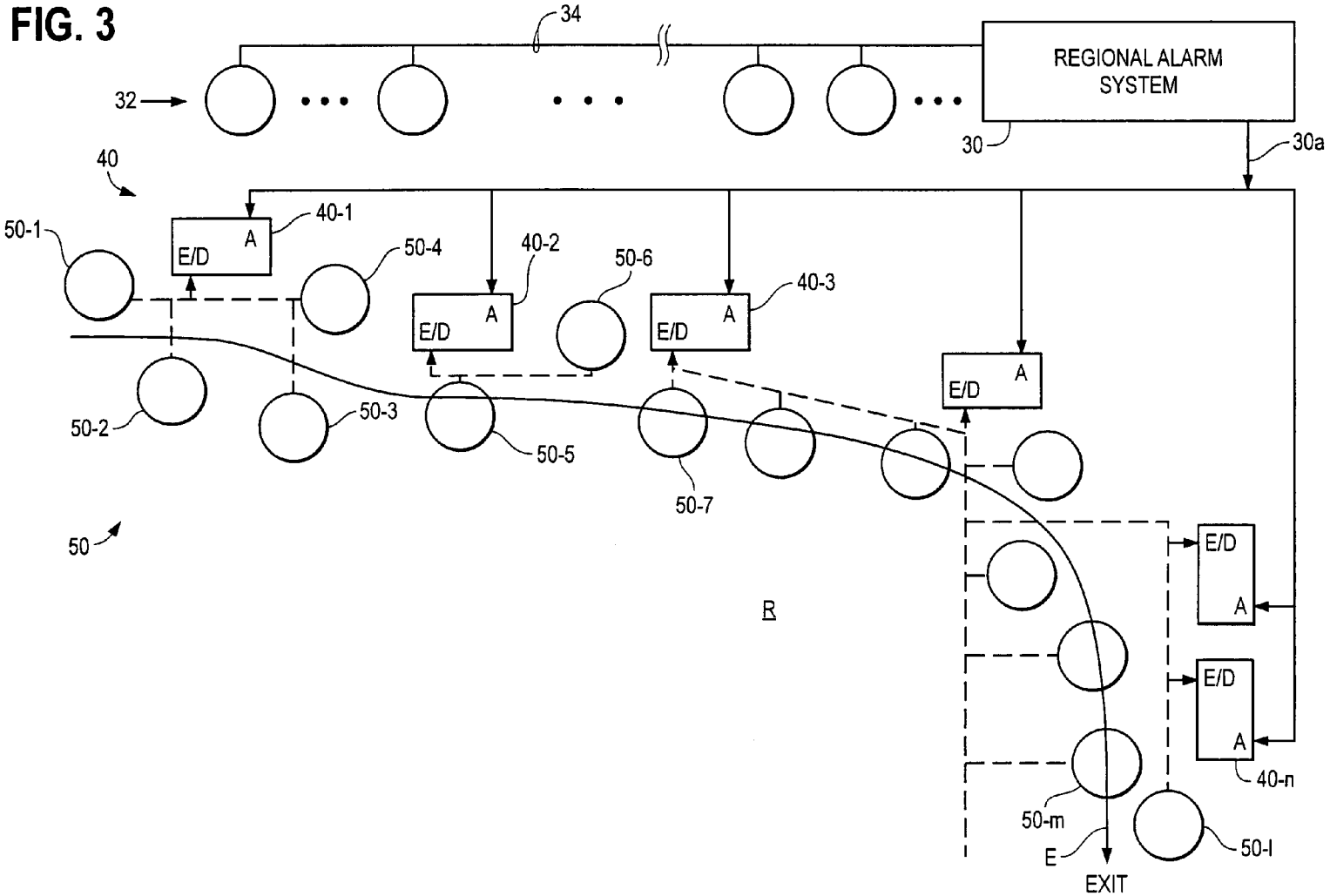
FIG. 3 is a top plan view of a system in accordance with the invention.

FIG. 3 illustrates a portion of the region R being monitored by a regional alarm system 30. Alarm system 30, as is conventional, incorporates a plurality of detectors 32 which might be dispersed throughout the region R.

The detectors 32 can be coupled by a wired or wireless medium 34, without limitation, to the alarm system 30. Alarm system 30 evaluates signals received from the members of the plurality 32 and determines, for example due to the presence of flame or smoke that a fire condition exists in a portion of the region R.

In response to such a determination, alarm system 30, via, for example line 30*a* can activate one or a plurality 40 of exit indicating or evacuation path indicating devices, comparable to the device 10. Each of the members of the plurality 40, such as indicator 40-1, 40-2 . . . 40-n is located so as to identify, illuminate or provide an audible indication of an evacuation path E, or exit through some or all of the region R.

The members of the plurality 40, each incorporates an alarm signal input port A which is coupled to the line 30*a*. Hence, in a normal operation regional alarm system 30 can activate the members of the plurality 40 upon sensing an alarm condition somewhere in the region R. As noted above, this activation is without regard to local conditions in the vicinity of the units 40-I.

Supplementing the alarm indicating signal on the line 30*a*, is a plurality of fire detectors 50. The members 50-1,

50-2 . . . 50-m are dispersed along portions of the evacuation route or path E and near the exit. The members of the plurality 50 provide feedback as to local smoke or fire related conditions on or adjacent to the pathway E, and adjacent to the exit. As described above relative to FIG. 2, the members of the plurality 50 can be used to disable some or all of the indicators of the plurality 40 depending on local smoke/fire conditions adjacent to, along or in the vicinity of an exit.

As illustrated in FIG. 3, detectors 50-1 . . . 50-4 coupled to the E/D port of indicator or enunciator device 40-1. If any of those detectors indicate a local alarm condition, which could be for example, sensed temperature, sensed smoke, sensed flame, sensed gases such as carbon dioxide, those detectors 50-1 . . . 50-4 which have detected a hazardous condition can each disable device 40-1 based on a local sensed condition.

Similarly, detectors 50-5, 50-6 which are coupled to the E/D port of path indicating device 40-2 can disable the audible or visual output therefrom in the event of a hazardous condition on or in the vicinity of the pathway E in the immediate area of output device 40-2. It will also be understood that the devices 50-1 . . . 50-4 could also be coupled to the E/D port of output device 40-2 without departing from the spirit and scope of the present invention.

Similarly, output devices 40-3 . . . 40-n have E/D ports coupled to a plurality of detectors 50-7 . . . 50-m located along or adjacent to exit path E. Detectors 50-1, 50-m are located in the vicinity of the exit itself. Any of the detectors 50-7 . . . 50-m can disable any of the respective output indicating devices 40-3 . . . 40-n.

As it will be understood by those skilled in the art, one type of enable/disable port can have terminals which accept normally open and/or normally closed contacts. A change of state at one of these terminals, normally open contacts closing or normally closed contacts opening, causes the respective output indicating device to become disabled. For example, normally open or normally closed contacts from the respective detectors can be directly connected to this form of E/D input port. In the case of normally open contacts, the detectors can be wired or connected in parallel to the port in order to provide an "or" function for the outputs of the respective detectors. Where the contacts are normally closed, the detectors can be wired in series to the E/D port of the indicating device to provide the "or" function. As those of skill in the art will understand, the detectors of the plurality 50 would be coupled to the respective members of the plurality 40 in accordance with their respective protocols to provide the desired "or" functionality.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. An alarm system comprising:

a first plurality of ambient condition detectors coupled by a medium to first control circuits to act as a source of alarm indicating signals;

a plurality of exit indicating output devices coupled by a second medium to second control circuits; and a second plurality of ambient condition detectors, at least some of the detectors are coupled to respective ones of the output devices to disable operation thereof in response to a locally sensed predetermined condition.

2. A system as in claim 1 where at least some of the output devices each include a disable port and where respective outputs from the at least some of the detectors of the second plurality are coupled to respective disable ports.

3. A system as in claim 1 where the first and second control circuits are coupled together.

4. A system as in claim 3 where the first control circuits provide control signals to the second control circuits.

5. A system as in claim 1 where the output devices emit at least one of an audible indicator or a visual indicator.

6. A method comprising:

determining that a hazardous condition is present in a region as indicated by at least one of a first plurality of ambient condition detectors;

providing spaced apart indicia along at least one exit path from the region; and determining if a hazardous condition is present in a vicinity of a portion of the exit path as indicated by at least one of a second plurality of ambient condition detectors, and, responsive thereto, terminating the indicia at least in that vicinity of the exit path.

7. A method as in claim 6 where providing indicia comprises providing at least visual indicia indicative of the exit path.

8. A method as in claim 6 where determining the hazardous condition comprises determining that a fire is present in the region.

9. A method as in claim 6 where determining if the hazardous condition is present comprises determining if an indication of fire is present in the vicinity of the portion of the exit.

10. A method as in claim 9 where providing indicia comprises at least one of illuminating at least one exit path from the region, or, audibly designating at least one exit path from the region.

11. A method as in claim 10 where terminating the indicia comprises at least one of terminating illumination of or, terminating audible designation of at least one exit from the region.

12. A method as in claim 6 which includes providing indicating indicia of a plurality of exits from the region.

13. A method as in claim 12 comprising:

determining for each of a plurality of exits if an indication of fire is present in the vicinity of the portion of the exit, and, responsive thereto, terminating the indicating indicia for the respective exit.

14. A system comprising:

a device that provides at least one output indicative of an outlet from a region, the device having a first housing that carries an alarm signal receiving port and an output disabling control port;

at least one ambient condition detector, the detector having a second housing separate from the first housing, the detector having at least one alarm output indicative of the presence of a predetermined alarm condition, the alarm output is coupled to the control port to disable the device in the presence of the predetermined condition; and which includes a plurality of ambient condition detectors each detector having a respective housing separate from the first housing, alarm indicating outputs of members of the plurality are coupled to the control port to disable the device in the presence of an alarm indicated by at least one member of the plurality.

15. A distributed control system comprising:

a source of alarm indicating signals as indicated by at least one of a first plurality of ambient condition detectors;

a plurality of egress indicating output modules, the modules configurable to emit outputs to define an egress path from a region;

a second plurality of ambient condition detectors, some of the detectors are coupled to at least a first output module, others are coupled to at least a second output module, where one or more alarm indicating outputs from the some detectors suppress the output from the first module and where one or more alarm indicating outputs from the others suppress the output from the second module.

16. A system as in claim 15 where each of the modules is carried in a respective housing and where the detectors are carried in different respective housings.

17. A system as in claim 16 where outputs from the some of the detectors are coupled to the first output module via a common medium.

* * * * *